US011365033B2

(12) United States Patent
Berresheim

(10) Patent No.: US 11,365,033 B2
(45) Date of Patent: Jun. 21, 2022

(54) APPARATUS AND METHODS FOR DISPENSING BEVERAGES

(71) Applicant: GLOBAL ADVANTAGE TRADING AND IMPORTS, LLC, St. Louis, MO (US)

(72) Inventor: Kenneth J. Berresheim, Grantwood Village, MO (US)

(73) Assignee: Global Advantage Trading and Imports, LLC, St. Louis, MO (US)

( * ) Notice: Subject to any disclaimer, the term of this patent is extended or adjusted under 35 U.S.C. 154(b) by 580 days.

(21) Appl. No.: 16/371,968

(22) Filed: Apr. 1, 2019

(65) Prior Publication Data

US 2020/0307873 A1 Oct. 1, 2020

(51) Int. Cl.

| | |
|---|---|
| ***B65D 47/30*** | (2006.01) |
| ***B65D 47/32*** | (2006.01) |
| ***A47G 19/22*** | (2006.01) |
| ***B65D 43/02*** | (2006.01) |

(52) U.S. Cl.

CPC ..... *B65D 47/305* (2013.01); *A47G 19/2272* (2013.01); *A47G 19/2288* (2013.01); (Continued)

(58) Field of Classification Search

CPC ..... A47G 19/2272; A47G 19/2288; A47G 19/2266; B65D 47/305; B65D 43/0229; B65D 47/32; B65D 2543/00046; B65D 2543/00092; B65D 2543/00231; B65D 2543/00518; B65D 2543/00546; B65D 2543/00435; B65D 47/00; B65D 47/04; B65D 47/20; B65D 47/06; B65D 47/061; B65D 47/065; B65D 47/066; B65D 43/00; B65D 43/02; B65D 43/0202; B65D 43/0225; B65D 43/18; B65D 41/04;

(Continued)

(56) References Cited

U.S. PATENT DOCUMENTS

| | | | |
|---|---|---|---|
| 4,903,870 | A | 2/1990 | La Vange |
| 5,244,113 | A | 9/1993 | Stymiest |

(Continued)

FOREIGN PATENT DOCUMENTS

| | | | |
|---|---|---|---|
| CN | 203268594 | U | 11/2013 |
| GB | 2293818 | A | 10/1996 |
| GB | 2478294 | A | 7/2011 |

*Primary Examiner* — Don M Anderson

(74) *Attorney, Agent, or Firm* — Lewis Rice LLC

(57) ABSTRACT

A dispensing system for use with a portable container for the storage, transport, and dispensation of fluids, especially liquids. The dispensing system includes an annular collar affixable to such a portable container. The collar is matable with a twist-top having a straw thereon. Once mated, corresponding structures on the collar and twist-stop prevent or inhibit separation. The twist-top can be twisted open to a position in which corresponding interior structures of the twist-top and collar form a fluid channel allowing liquid in the container to flow past sealing elements such as a gasket, and to egress to a contoured surface for sipping hot liquids by a human. The twist-top can be twisted close to reseal and inhibit fluid egress. Alternatively, a rotatable flip straw in the twist-top can be opened to drink cold liquids from the container while the twist-top is sealed in closed position.

19 Claims, 15 Drawing Sheets

(52) U.S. Cl.
CPC ..... *B65D 43/0229* (2013.01); *B65D 47/32* (2013.01); *B65D 2543/00046* (2013.01); *B65D 2543/00092* (2013.01); *B65D 2543/00231* (2013.01); *B65D 2543/00518* (2013.01); *B65D 2543/00546* (2013.01)

(58) Field of Classification Search
CPC ..... B65D 41/0414; B65D 41/0428; B65D 41/0442; B65D 41/0471; B65D 41/0478; B65D 51/18; B65D 39/08; B65D 39/10
See application file for complete search history.

(56) References Cited

U.S. PATENT DOCUMENTS

| | | | |
|---|---|---|---|
| 5,509,551 | A | 4/1996 | Terrell, II |
| 6,783,019 | B2 | 8/2004 | Zettle et al. |
| 7,913,869 | B2 | 3/2011 | Cuocolo, Jr. |
| 8,272,532 | B2 | 9/2012 | Michaelian et al. |
| 8,276,776 | B2 | 10/2012 | Roth et al. |
| 8,668,106 | B1 | 3/2014 | Joy et al. |
| 8,777,039 | B2 | 7/2014 | Roth et al. |
| 9,339,007 | B2 | 5/2016 | Roth |
| 9,380,898 | B2 | 7/2016 | Mason |
| 9,745,110 | B2 | 8/2017 | Boyer et al. |
| 2009/0084752 | A1 | 4/2009 | Coulson |
| 2009/0101617 | A1 | 4/2009 | Viggiano |
| 2010/0237078 | A1 | 9/2010 | Lentz et al. |
| 2011/0198352 | A1 | 8/2011 | Lown et al. |
| 2011/0204053 | A1 | 8/2011 | Umholtz et al. |
| 2012/0234789 | A1 | 9/2012 | Mason |
| 2017/0050775 | A1 | 2/2017 | Sanbar |
| 2017/0253394 | A1 | 9/2017 | Fogarty et al. |
| 2018/0050845 | A1* | 2/2018 | Chin ..... A47G 19/2272 |
| 2019/0161246 | A1* | 5/2019 | Lane ..... B65D 55/165 |

* cited by examiner

APPARATUS AND METHODS FOR DISPENSING BEVERAGES

BACKGROUND OF THE INVENTION

Field of the Invention

This disclosure is related to the field of beverage containers, and more particularly to apparatus and methods for distributing fluids of varying temperatures from a fluid container using a single dispensing structure from both.

Description of the Related Art

In an ever-faster moving world, consumers increasingly demand ready access to easy-to-use, easy-to-clean, multipurpose portable containers for temporary, short-term storage of food, beverages, and other perishable goods. This is particularly true with fluids, most of which are desired to be maintained at a temperature either above or below room temperature. For example, dairy-based products, such as milk, must be kept below room temperature for safe consumption, but other fluids, such as coffee, are usually consumed hot.

Even beverages that are perfectly safe at room temperature, such as water, are preferably consumed cold. This is because water is often consumed for rehydration in connection with exercise or other exertion, in which case the coolness of the liquid provides additional cooling to the body. Moreover, cold beverages are believed to have a mild numbing effect on unwanted flavors. It has also been suggested that a preference for hot and cold beverages could have psychological or evolutionary influences. Colder and hotter beverages contrast more strongly with the ambient temperature of the body, and thus the sensation of consuming is more acute, satisfying the psychological need to consume. Additionally, room or ambient temperature liquids are more likely to contain environmental pathogens than liquids that have been cooled or boiled.

Not surprisingly, market demand for portable containers for fluids has increased. At cross-purposes with this demand, however, is the desire to simplify and de-clutter our lives by getting rid of unnecessary duplication and consuming less. In the case of beverage containers, consumers demand a single container that can store and dispense both hot and cold beverages, allowing the same container to be used, for example, to store hot coffee in the morning, and then easily washed and cleaned and filled with water or a protein drink for an afternoon jog. Consumers don't want to have to store, transport, and clean multiple bottles.

However, designing a single bottle suitable for use with both cold and hot beverages is tricky because consumers prefer to consume cold and hot drinks differently. Cold drinks are often consumed in large or repeated gulps, such as an athlete drinking water quickly during a rest. Often, such drinks are consumed through a straw, which allows the fluid to be transported out of the container via the straw while also providing a lid to inhibit spills and simplify transportation.

However, hot beverages are not normally consumed from a straw, but rather are sipped. The reasons for this aren't widely understood, but it is believed to be related to the physical forces involved in using a straw. These forces generally require the use of the mouth to create a vacuum at the dispensing end of the straw, and drawing back in to reduce air pressure inside the oral cavity. This reduction in pressure then draws fluid through the straw and into the mouth. The pressure differential in turn causes the liquid to enter the oral cavity pressurized, and the volume of fluid touches the interior of the mouth concentrated in a small surface area. By contrast, when sipping from the edge of a gap, the volume of liquid is unpressurized, and is spread across the larger surface area, reducing scalding.

There is thus a need in the art to combine the convenience of a straw dispenser for cool beverages with the need for a sipping dispenser for hot beverage combined into a single, reusable, easy-to-clean and easy-to-maintain container.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a liquid dispensing system comprising: a liquid storage vessel; a generally annular collar comprising: a top portion having a contoured inner surface and a rim configured for a human to sip liquid therefrom; a middle portion adjacent the top portion and comprising: a first attaching member circumscribing an outer surface of the collar and sealedly attachable to the liquid storage vessel; and a second attaching member circumscribed by an inner surface of the middle portion and having a first gap extending vertically therethrough along the inner surface, the second attaching member comprising at least one stopping element; a twist-top having a third attaching member circumscribing an outer surface thereof matable with the second attaching member, the third attaching member having a second gap extending vertically therethrough along the outer surface, the third attaching member comprising: a first detent sized and shaped to allow the stopping element to move over and past the first detent in a first direction to mate the second attaching member to the third attaching member to assemble the liquid dispensing system, and inhibiting the stopping element from moving back over and past the first dent in a second direction opposite the first direction to unmate the second attaching member from the third attaching member to disassemble the liquid dispensing system; a second detent disposed adjacent the first detent and forming a recess therebetween, the second detent sized and shaped to allow the stopping element to move over and past the second detent stop from either direction with the application of a predetermined amount of torque; wherein when the second attaching element is mated to the third attaching element to assemble the liquid dispensing system: the twist-top is rotatable to an open position in which the stopping element is disposed adjacent the first detent; the twist-stop is rotatable to a closed position in which the stopping element is disposed distal the first detent.

In an embodiment, the twist-stop further comprises one of more apertures disposed at a radial periphery of the twist-top adjacent a top end of the channel when formed, and disposed on the radial periphery effective to allow liquid flowing through the formed channel to further flow through the one or more apertures and unto the contoured inner surface.

In an embodiment, the one or apertures disposed at the radial periphery comprises a number of apertures having a size, shape, and disposition on the radial periphery effective to cause liquid to flow through the one or more apertures at a predetermined flow rate.

In an embodiment, the predetermined flow rate is selected to inhibit hot liquid flowing through the one or more apertures from burning human skin when a human drinks hot liquid through the one or more apertures.

In an embodiment, the twist-top further comprises a top having a rotatable straw disposed thereon, the rotatable straw having a channel extending therethrough and the rotatable straw adjustable between a closed position in which liquid flow through the channel is inhibited and an open position in which liquid flow the channel is allowed.

In an embodiment, the straw is disposed in a recess defined by a raised periphery sized and shaped for gripping to rotate the twist-stop with respect to the collar.

In an embodiment, the twist-top further comprises a secondary vent sized, shaped, and positioned to facilitate liquid flow through the straw when the straw is open via pressure equilibrium.

In an embodiment, the secondary vent is disposed beneath the straw when the straw is in closed position.

In an embodiment, the liquid dispensing system further comprises a generally annular gasket having an L-shaped cross-section and sized and shaped to fit between the collar and the twist-top to form a liquid seal therebetween, the fluid channel formed by the first gap and the second gap bypassing the gasket when formed.

In an embodiment, the first attaching member comprises threads adapted to counter-rotate with corresponding threads on a top interior surface of the liquid storage vessel.

In an embodiment, the annular collar is permanently affixed to the liquid storage vessel.

In an embodiment, the liquid storage vessel is an insulated liquid storage container.

In an embodiment, the annular collar is permanently affixed to the liquid storage vessel by an adhesive.

In an embodiment, the second attaching member comprises threads and the third attaching member comprises corresponding threads.

In an embodiment, the second attaching element is mated to the third attaching element to assemble the liquid dispensing system and the twist-top is in the open position, the first gap and the second gap at least partially overlap to form a channel between the collar and the twist top.

In an embodiment, when the second attaching element is mated to the third attaching element to assemble the liquid dispensing system and the twist-top is in the closed position, the first gap and the second gap do not form a channel between the collar and the twist top.

In an embodiment, the stopping element is prevented from moving back over and past the first dent in a second direction opposite the first direction unless a second predetermined amount of torque is applied.

In an embodiment, the second predetermined amount of torque is greater than the predetermined amount of torque.

In an embodiment, the second predetermined amount of torque is at least ten times greater than the predetermined amount of torque.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Figure 11:
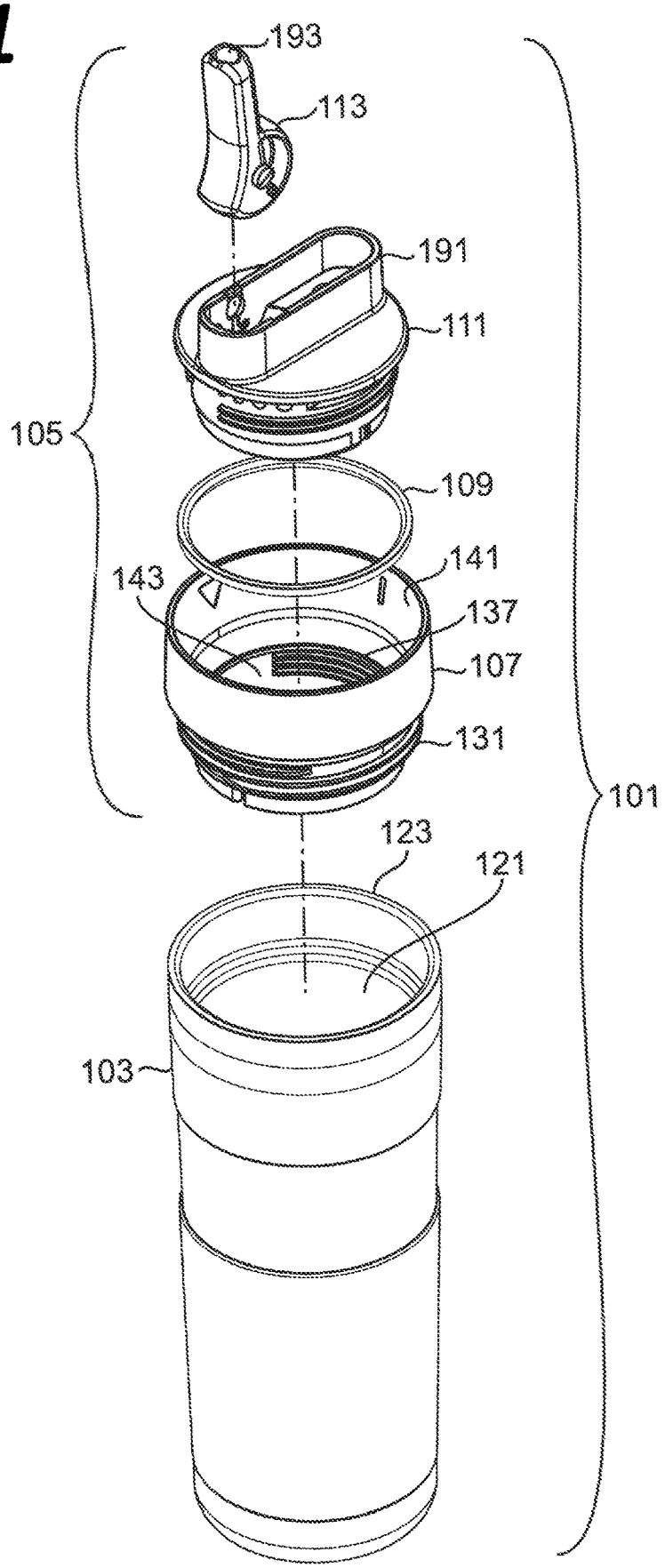
FIG. 11 depicts an exploded view of an alternative embodiment of a beverage container as described herein.

Described herein, among other things, is a "sip-and-straw" portable container (101) for the storage, transport, and dispensation of fluids. FIGS. 1-10 provide various views of an embodiment of such a container and its components. FIG. 11 depicts an exploded view of an embodiment of portable container (101) as described herein. In the depicted embodiment, the portable container (101) comprises a storage vessel (103) and a dispensation system (105). The following description is generally made with respect to such a container (101) for use with hot and cold consumable liquids, but a person of ordinary skill in the art will readily appreciate that the structures and functions described herein are applicable to any use case in which it is desirable to dispense a fluid from a container using multiple dispensation structures.

The depicted storage vessel (103) will typically be an insulated container of any kind now known or in the future developed in the art. Such vessels (103) may be made from plastic, glass, metal, and are generally free from harmful materials that may leech into a liquid stored therein. The depicted vessel (103) is generally in the configuration of an elongated cylinder, but this is by no means limiting and other shapes are possible. The vessel (103) may differ in shape, dimension, structure, construction methodology, materials, and composition depending upon the particular needs of each embodiment's intended use. The vessel (103) generally comprises at least one vessel opening (121) or vessel aperture (121) through which fluids may be stored in, and removed from, the vessel (103). In the depicted embodiment, this vessel opening (121) is an open end at one end of the cylinder. The vessel (103) may further comprise one or more attaching members (123) for sealedly attaching a dispensing system (105) thereto. In the depicted embodiment of FIG. 11, the attaching member (123) comprises a set of threads disposed circumferentially around the interior of the vessel (103) at or near the vessel opening (121). The depicted threads (123) are configured for interlocking with corresponding threads (131) of the dispensation system (105).

Figure 1:
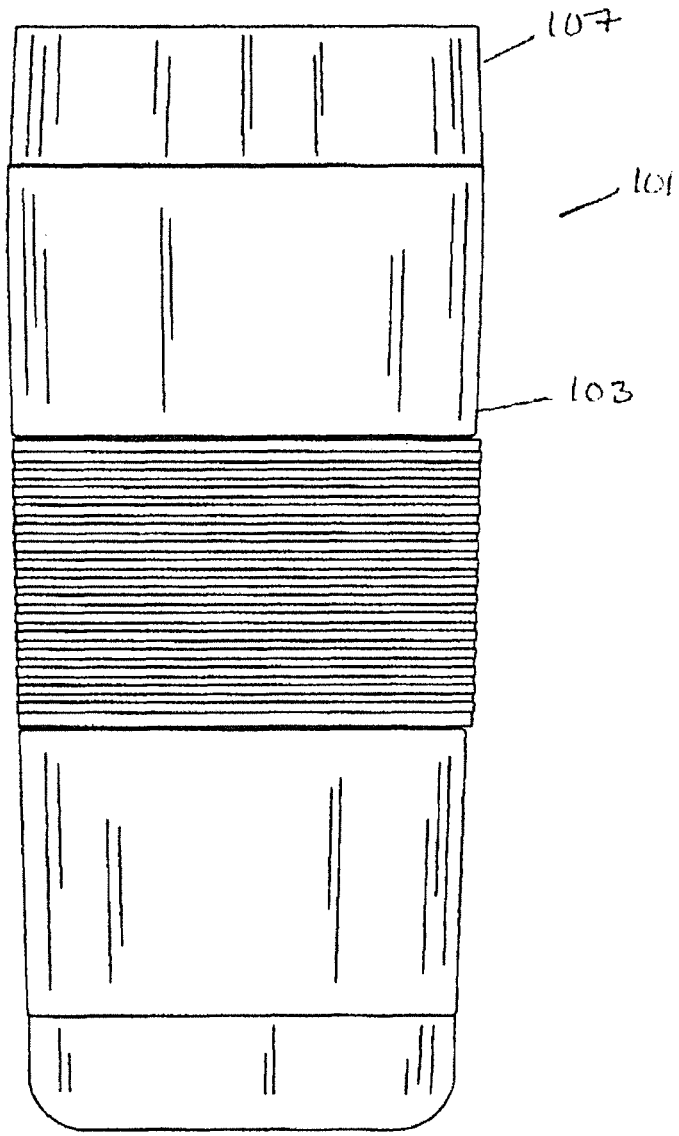
FIG. 1 depicts a front view of an embodiment of a beverage container as described herein, assembled and having an openable straw in closed position, the back, left, and right views being identical.
Figure 2:
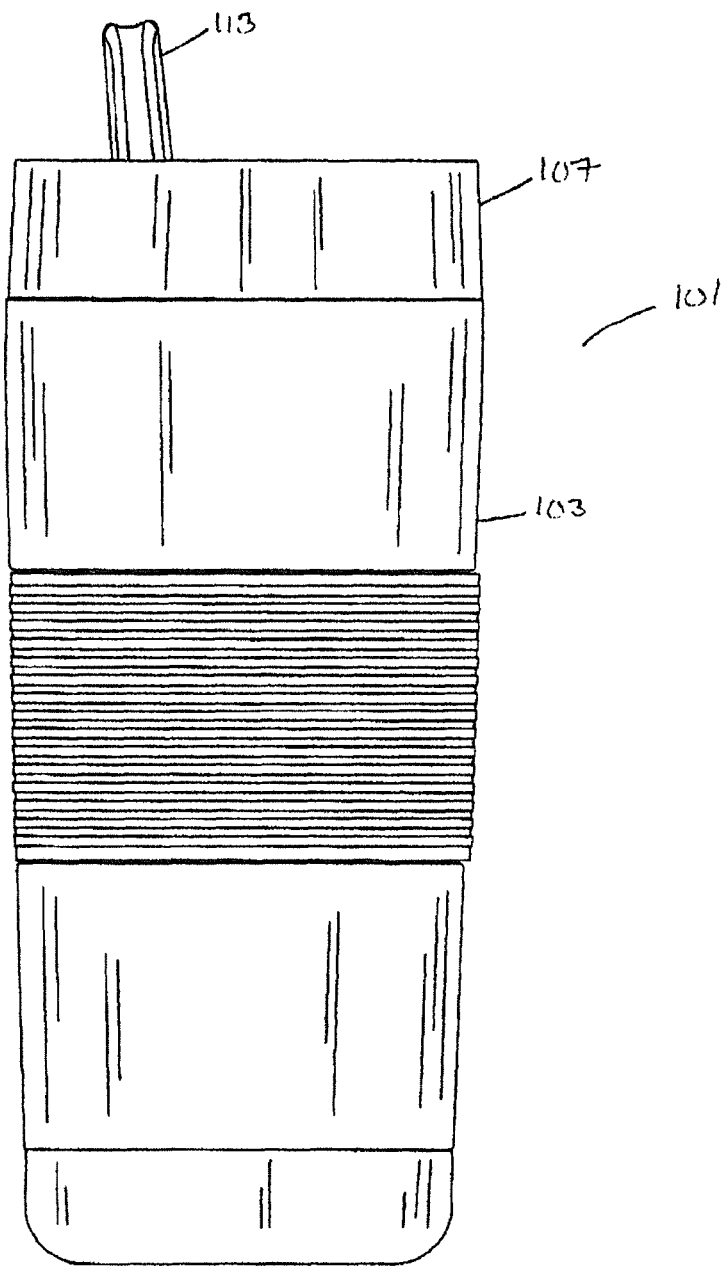
FIG. 2 depicts a left side view of the embodiment of FIG. 1 with the straw in open position, the right side view being a mirror image thereof.
Figure 3:
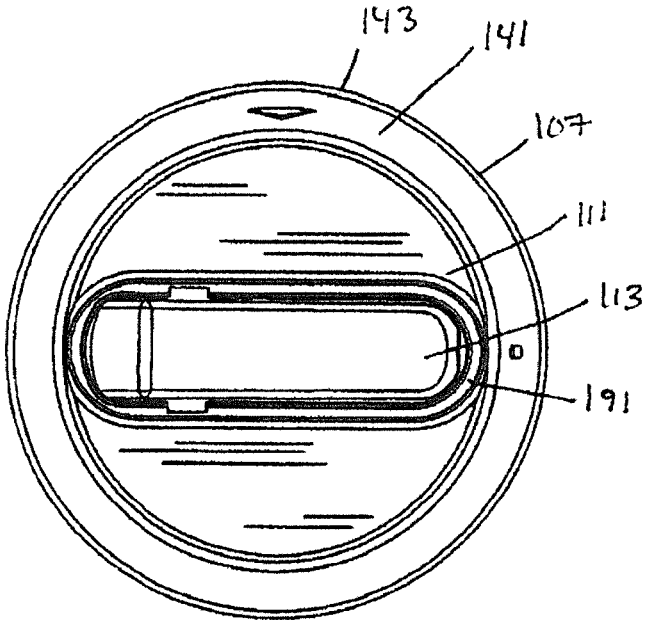
FIG. 3 depicts a top view of the embodiment of FIG. 1 with the straw in closed position.
Figure 4:
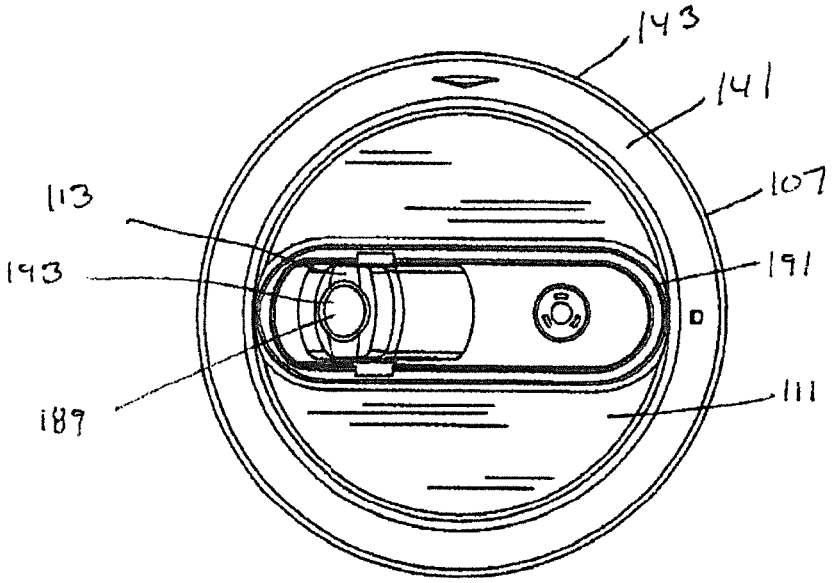
FIG. 4 depicts a top view of the embodiment of FIG. 1 with the straw in open position.
Figure 5:
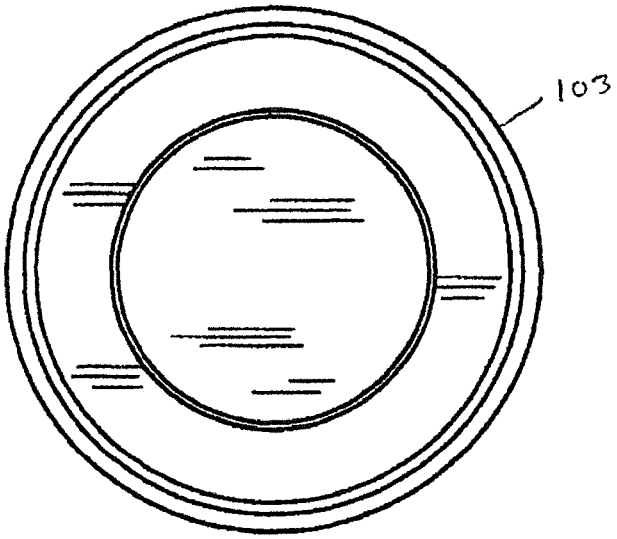
FIG. 5 depicts a bottom view of the embodiment of FIG. 1, this view being the same regardless of the position of the straw.
Figure 6:
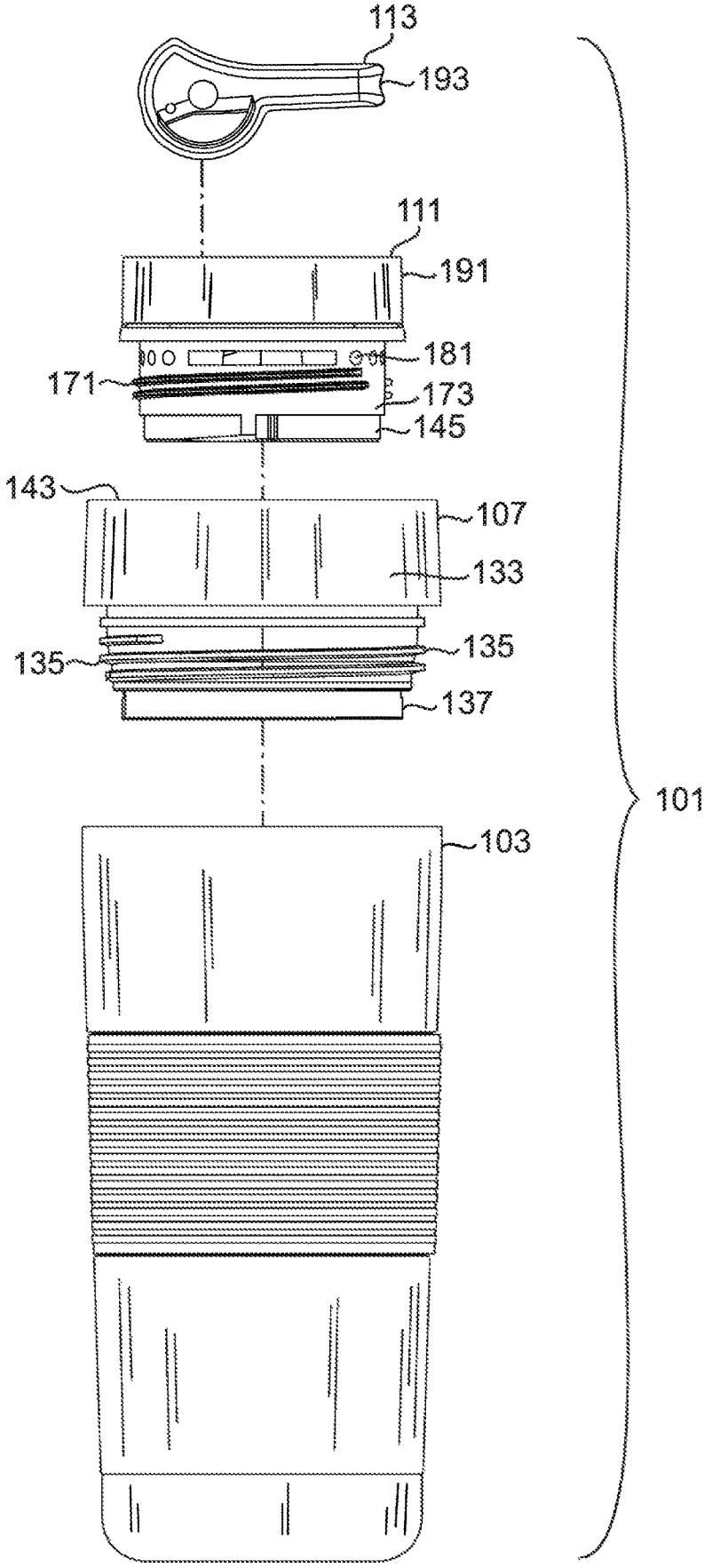
FIG. 6 depicts an exploded view of the embodiment of FIG. 1.
Figure 7:
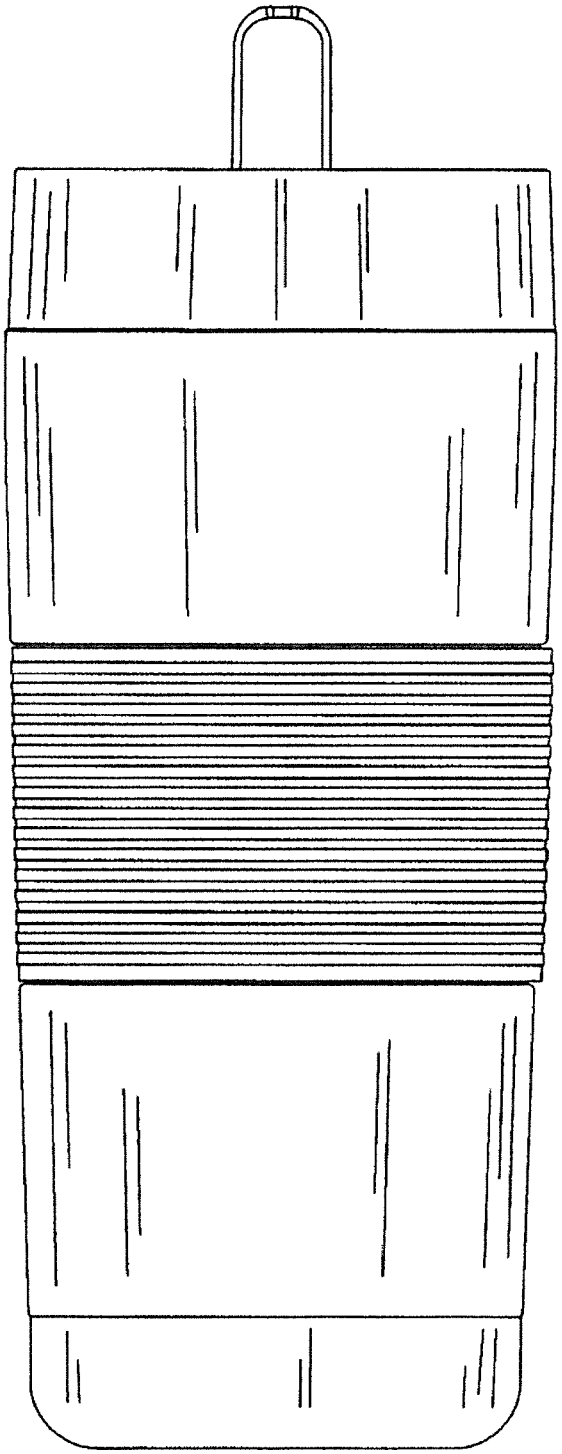
FIG. 7 depicts a back view of the embodiment of FIG. 1 with the straw in open position.
Figure 8:
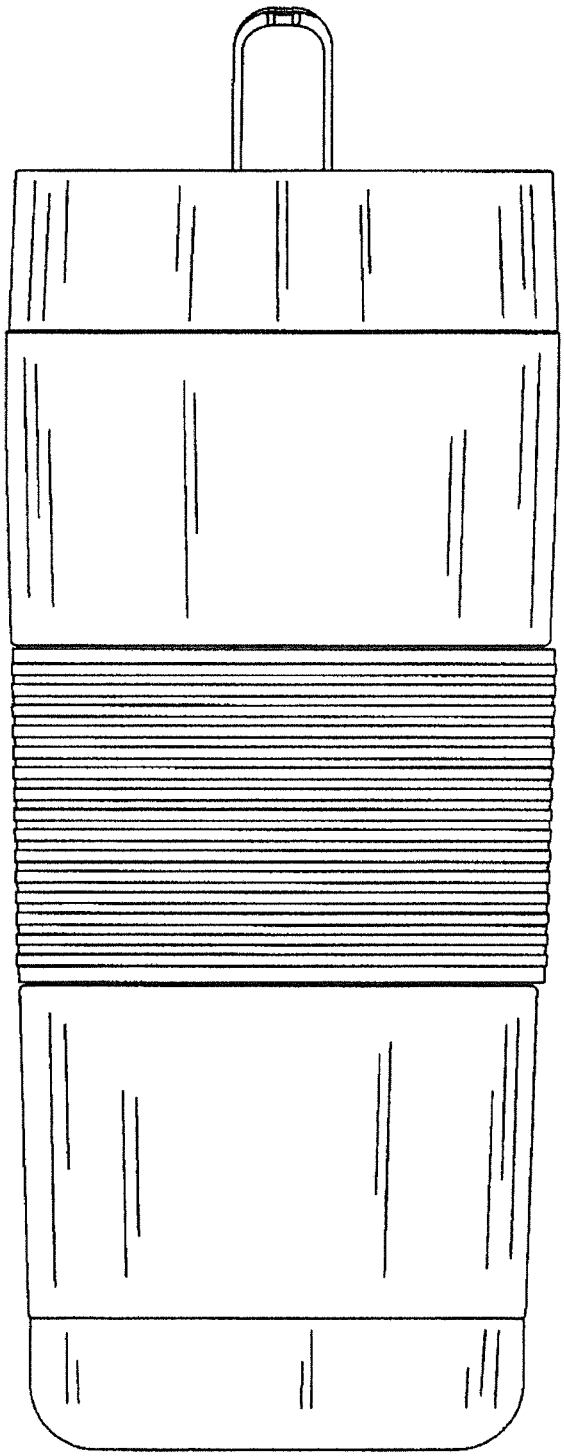
FIG. 8 depicts a front view of the embodiment of FIG. 1 with the straw in open position.
Figure 9:
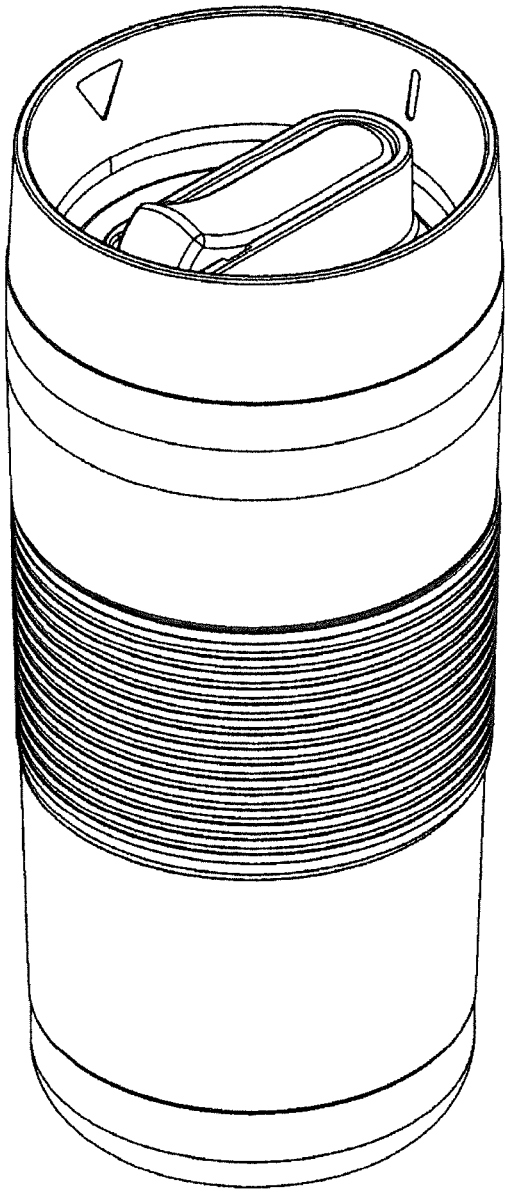
FIG. 9 depicts a top front right isometric view of the embodiment of FIG. 1 with the straw in closed position.
Figure 10:
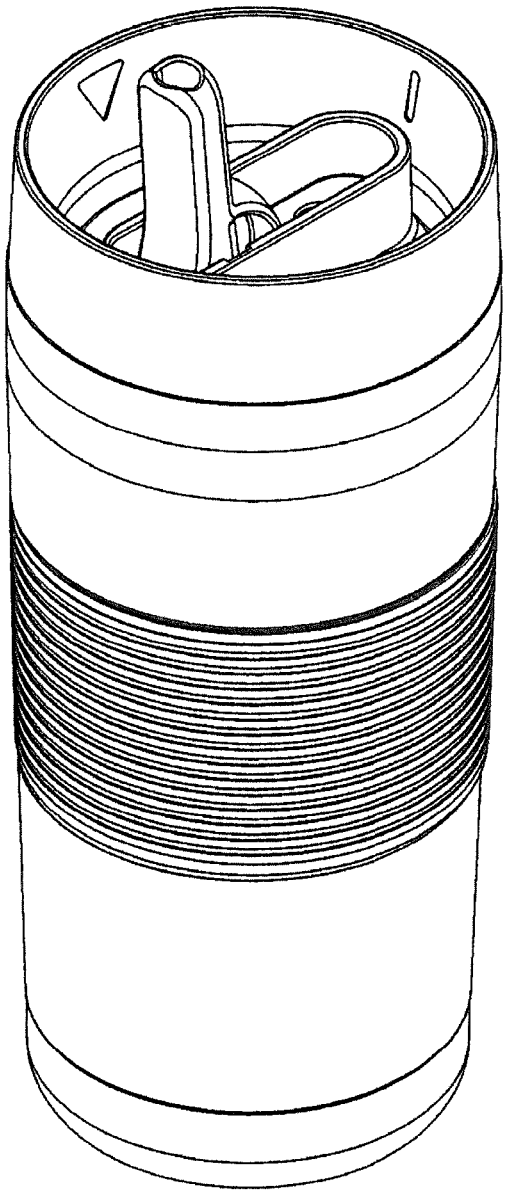
FIG. 10 is a top front right isometric view of the embodiment of FIG. 1 with the straw in open position.

The depicted dispensation system (105) of FIG. 1 comprises four primary components: a collar (107), a gasket (109), a twist-top (111) and a straw (113). Each of these components is described in further detail herein. The dispensation system (105) may comprise one or more attaching members (131) for sealedly attaching the dispensation system (105) to a vessel (103). In the depicted embodiment of FIG. 11, the attaching member (131) comprises a set of threads (131) disposed circumferentially around the exterior of the collar (107). The depicted threads (131) are configured for interlocking with corresponding threads (123) on the vessel (103).

In an embodiment, the container (101) may be assembled by permanently or semi-permanently affixing the collar (107) to the vessel (103). For example, an adhesive may be applied to the threads (123) and (131) during construction to permanently affix the collar (107) to the vessel (103) such that, from the perspective of a user or consumer, the vessel (103) and collar (107) are a single functional unit (e.g., "the bottle"). In another embodiment, the collar (107) may be removably and sealedly tightened on the vessel (103) so that an end-consumer can remove the collar (107) from the vessel (103) for cleaning and maintenance without damaging either.

Figure 12A:
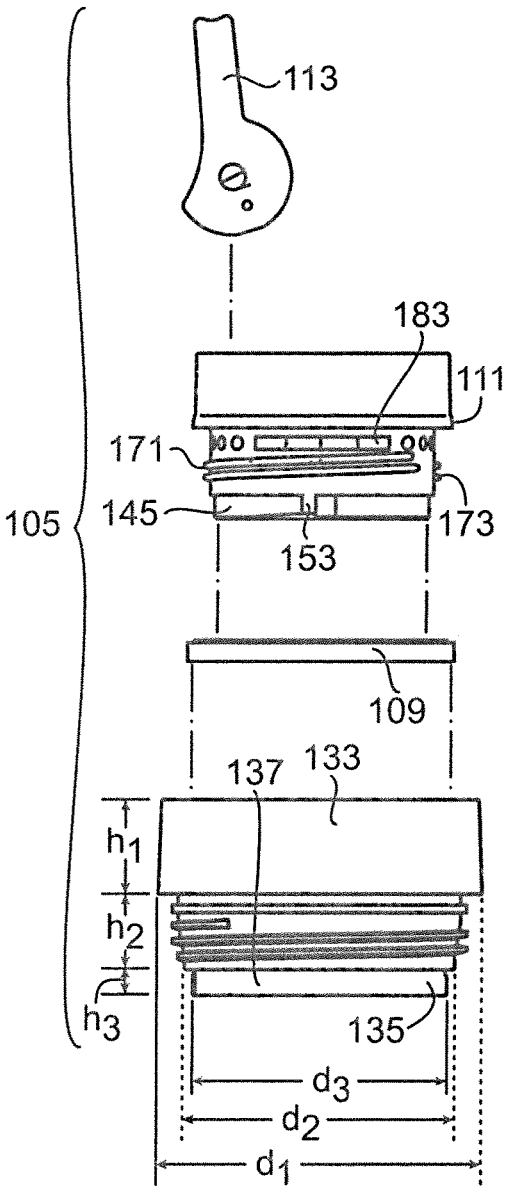
FIGS. 12A, 12B, 12C, and 12D depict exploded views of an embodiment of a dispensation system as described herein.

The depicted collar (107) comprises a top (133), middle (135), and bottom (137). These sections are each generally annular and disposed coaxially and concentrically in a vertical stack. In the depicted embodiment, the collar bottom (137) is disposed within the vessel (103) when assembled, the collar top (133) being disposed outside the vessel (103) when assembled, and the collar middle (135) disposed therebetween. However, in alternative embodiments, other connection relationships are possible, such as, but not limited to, by the collar circumscribing the vessel and attaching to an outside surface thereof. As shown in FIG. 12A, the collar top (133) has height h1, the collar middle (135) has height h2, and the collar bottom (137) has height h3. Similarly, the collar top (133) has diameter d1, the collar middle (135) has diameter d2, and the collar bottom (137) has diameter d3. In the depicted embodiment, the diameter d1 of the collar top (113) is larger than the diameter of the collar middle (135) or collar bottom (137), and the diameter d2 of the collar middle (135) is larger than the diameter d3 of the collar bottom (137). The depicted collar middle (135) comprises one or more attaching members (131) disposed on the outside surface thereof. The depicted attaching members (131) are threads (131) configured for interlocking with the threads (123) on the top interior surface of the vessel (103), but other attaching members (131) could be substituted.

The depicted collar top (133) is an annular element which functions as a "pour" or "sip" surface. The depicted collar top (133) is generally in the configuration of an axially elongated annular member, having a contoured inner surface (141) and a rim (143) configured for sipping a beverage. The contoured inner surface (141) is angled from the radial center axis of the top (133) so that when a user tips the assembled container (101) for sipping, the contour provides a downward-sloping path so that gravity can draw the beverage to the rim (143). This reduces unwanted pooling and also reduces the amount that the user must tilt or angle the container (101) during use.

The diameter d3 of the collar bottom (137) is generally configured to conform to the inner diameter of a corresponding inner surface of the storage vessel (103). When the collar (107) is attached to the storage vessel (101), the mating of the collar bottom (137) with a corresponding inner surface of the storage vessel (101) generally forms a seal such that fluid is inhibited from escaping the storage vessel (103) through a path between the outer surface of the collar (107) and the inner surface of the storage vessel (101).

In the depicted embodiment, the collar middle (135) comprises an attaching member/threads (131) disposed on an outside surface and generally circumscribing the outer circumference of the collar middle (135). In the depicted embodiment, the collar middle (135) further comprises a second attaching member (139) disposed an opposing inside surface of the collar middle (135). The depicted second attaching member (139) is a second set of threads (139), but other attaching members could be used. The depicted second set of threads (139) is configured to interlock with corresponding threads (171) disposed on an exterior surface of the twist-top (111), as described in more detail elsewhere herein. It should be noted that the second attaching member (139) comprises at least one gap section (147) extending vertically along the inner surface of the collar middle (135). This gap section (147) contributes to fluid flow as described elsewhere herein. A single gap section (147) is shown in the depicted embodiment of FIG. 12B, but this is by no means limiting, and a different number of gap sections (147) may be present in an alternative embodiment.

The depicted gasket (109) is a generally annular rubber gasket. The depicted gasket (109) has an inverted L-shaped cross-section, as seen in FIG. 12C. The gasket (109) is sized and shaped so that it can be disposed between the collar (107) and twist-top (111) when the dispensing system (105) is assembled, as described elsewhere herein. The gasket (109) will generally be constructed of rubber or other substance which is safe for use in a container for consumable products and which will impart little or no taste to the consumable. The depicted gasket (109) may be a floating member not configured or adapted for permanent affixation to the collar (107) or twist-top (111). This allows the gasket (109) to be separately cleaned and maintained, and, if necessary, replaced in the event of damage or failure, without having to replace the entire collar (107) or twist-top (111) assembly. Alternatively, the gasket (109) may be attached to or integrally formed with the collar (107).

Figure 13A:
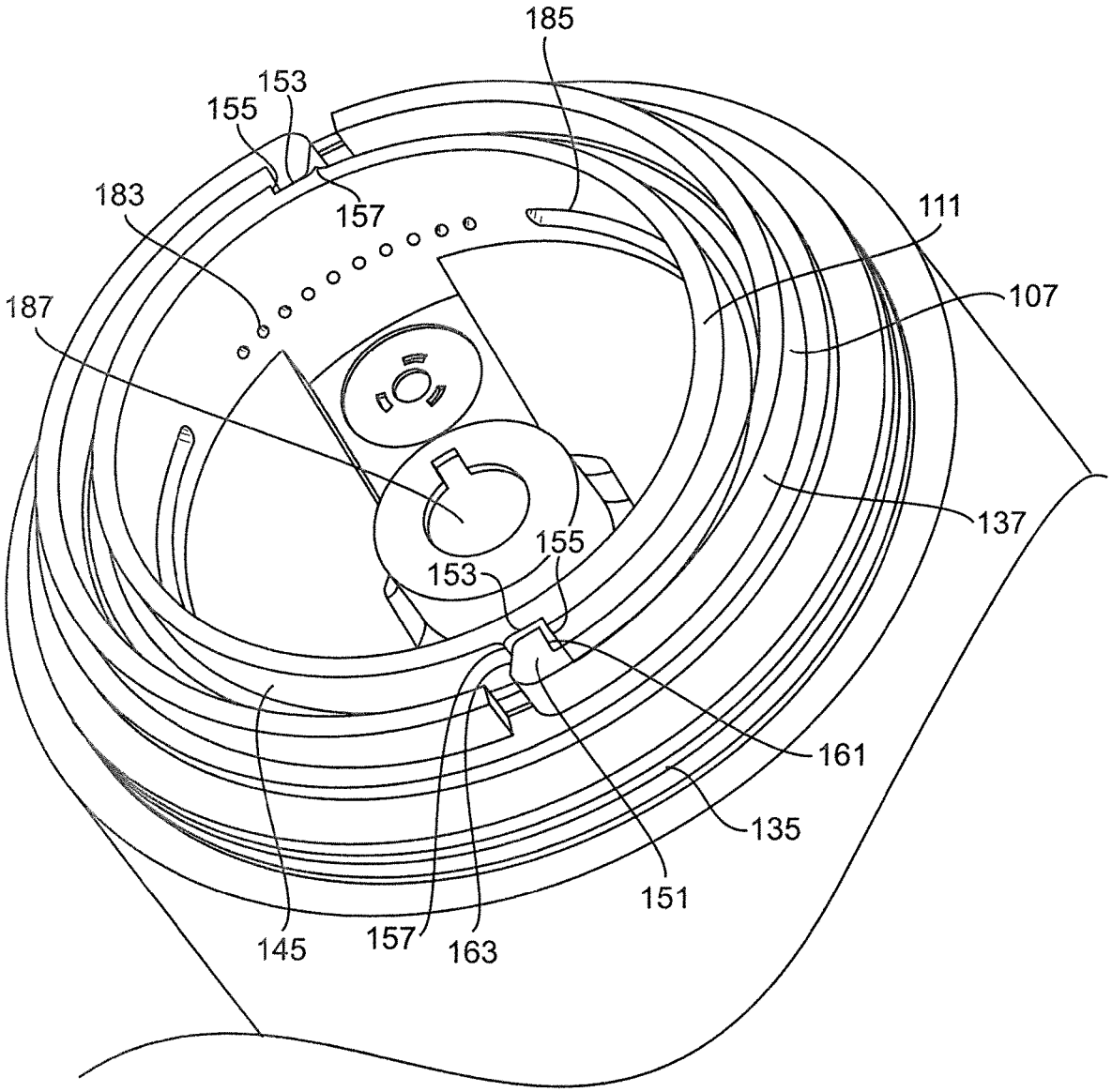
FIGS. 13A and 13B depict an embodiment of a twist-top locking system as described herein.
Figure 13B:
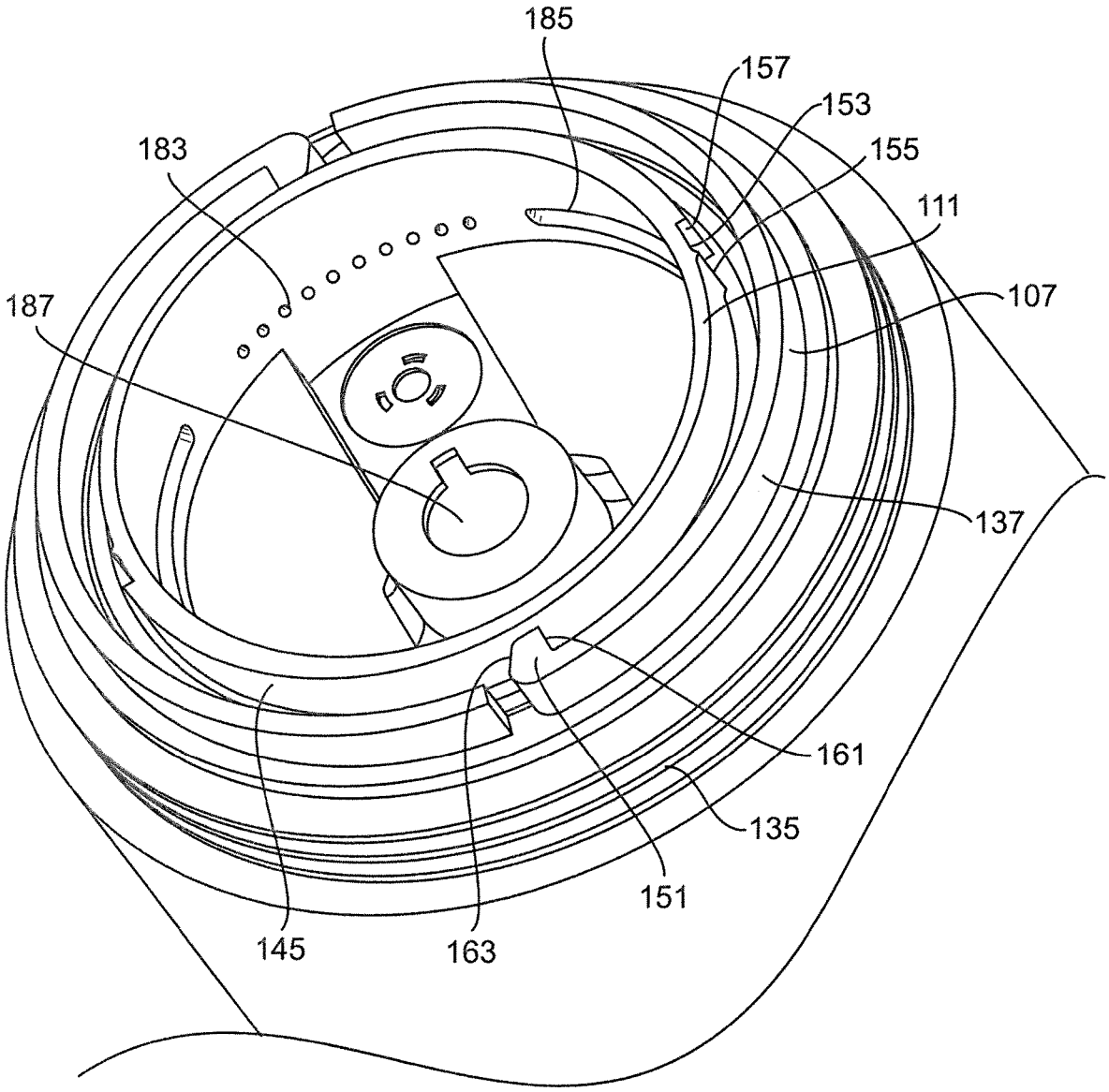

The interaction of the collar (107) and twist-top (111) is described with respect to the depicted embodiments of FIGS. 13A and 13B. As can be seen in the FIGS., the collar bottom (137) is shown as a generally annular element. When the twist-top (111) is screwed or twisted into engagement with the collar (107), a corresponding bottom element (145) of the twist-top (111) is disposed within the collar bottom (137), and the collar bottom (137) generally circumscribes the twist-top bottom (145).

The respective bottoms (145) and (137) contain corresponding elements designed to interact and interlock to prevent or inhibit the twist-top (111) from becoming disengaged from the collar (107) once assembled, and also to facilitating the flow of fluid through the dispensation system (105) for consumption by sipping. The twist-top bottom (145) comprises at least one detent (157) sized and shaped to inhibit a corresponding stopping element (151) disposed on the collar bottom (137) from passing said detent (157) after the device is assembled. The depicted detent (157) is adjacent a recess (153) formed by the first detent (157) and a second detent (155).

The depicted second detent (155) is essentially a bump or protrusion disposed radially outward on the outer rim of the twist-top bottom element (145), which has a gradually sloping leading and trailing edge, as shown in the FIGS. This leading and trailing edge facilitates locking and unlocking (e.g., engaging and disengaging) with the collar bottom (137) via the corresponding stopping element (151) as described elsewhere herein. The second detent (155) is disposed at the "leading" edge of the recess (153); that is, when the twist-top (111) is rotated from closed position (FIG. 13A) to open position (FIG. 13B), or from open position (FIG. 13B) to closed position (FIG. 13A), the stopping element (151) is moved over and past the second detent (155).

The depicted first detent (157) is also essentially a bump or protrusion disposed radially outward on the outer rim of the twist-top bottom element (145), but has a different configuration from the second detent (155). The depicted first detent (157) has a flat leading edge with little or no slope, effectively disposed generally perpendicularly to a tangent line to the exterior of the twist-top bottom (145). This flat stop configuration inhibits or prevents the twist-top (111) from being decoupled from the collar (107) once assembled. However, the twist-top (111) can still be easily mated to the collar (107).

The depicted stopping element (151) is generally in the configuration of a bump or protrusion disposed radially inward on the interior rim of the collar bottom (137), with a flat leading edge (161) and an angled trailing edge (163). The flat leading edge (161) corresponds to the first detent (157) in that it is generally perpendicular to a tangent line, such that when the twist-top (111) is in "open" position (FIG. 13B), the flat leading edge (161) of the stopping element (151) engages the first detent (157) to inhibit or prevent further rotation of the twist-top (111). However, the trailing edge (163) of the stopping element (151) has a sloping angle that roughly corresponds to that of the second detent (155). Thus, although the second detent (155) will capture and hold the stopping element (151) in place when the twist-top (111) is in open position (FIG. 13B), the corresponding angles of the second detent (155) and trailing edge (163) allow the twist-top (111) to be rotated back to closed position (FIG. 13A) through sufficient application of torque.

The device is "opened" by rotating the twist-top (111) so that the stopping element (151) is adjacent or proximal the first detent (157), and the device is "closed" by rotating the twist-top (111) so that the stopping element (151) moves clockwise, causing the twist-top (111) to bear down on and statically engage the collar (107). In this configuration, the twist-top (111) and collar (107) are mutually sealed by the gasket (109) described elsewhere herein. The first detent (157) allows the device to be opened by a certain degree but inhibits the twist-top (111) from being fully decoupled from the collar (107) during ordinary use. Thus, the user can open the device by twisting the twist-top (111) until the stopping element (151) contacts the first detent (157), at which point the twist-top (111) stops. This is the user's cue that the device is open. In an embodiment, a sufficient application of force, in an amount well in excess of the forces exerted on the device when in normal use, may be used to cause the twist-top (111) to be twisted beyond this point such that the twist-top (111) can be decoupled from the collar (107). The elements may be sized and shaped effective to cause the amount of force required to exceed normal operating forces by an amount effective to prevent accidental decoupling during normal use. In an embodiment, this amount of force may be many times higher than the amount of force applied to rotate the twist-top (111) during normal use, and may be an order of magnitude or more higher.

The height, shape, size, thickness, angles, and other configuration characteristics of the second detent (155) and stopping element (151) are selected so that the twist-top (111) can be easily rotated by a human user from closed to open and vice versa through the application of torque to the twist-top (111), but accidental or inadvertent rotation is inhibited. Similarly, the height, shape, size, thickness, angles, and other configuration characteristics of the second detent (155) and stopping element (151) are selected so that the twist-top (111) cannot be easily rotated by a human user beyond the open position to separate the twist-top (111) from the collar (107). In an embodiment, such rotation is prevented such that those elements (111) and (107) are not removably coupled. In an alternative embodiment, such rotation is inhibited such that those elements (111) and (107) can be decoupled only by application of a force well in excess of those active on the product during normal use.

The depicted embodiments of FIGS. 13A and 13B depict a pair of stopping elements/detent combinations, each disposed on approximately opposing sides of the collar bottom (137) and twist-top bottom (145). Although two such sets of structures are shown, in an alternative embodiment, a single set of structures, or more than two structures, may be used.

Figure 12B:
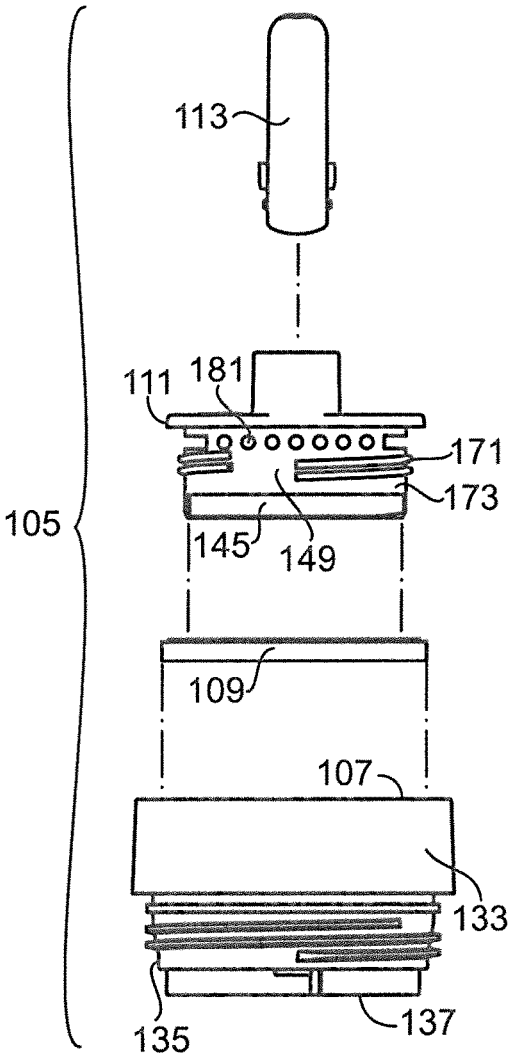
Figure 12C:
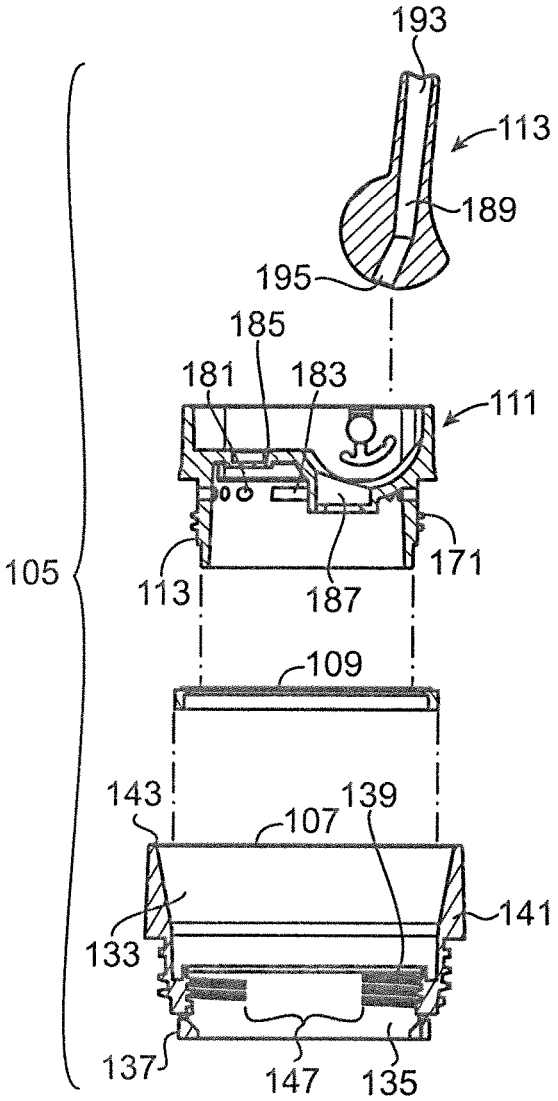
Figure 12D:
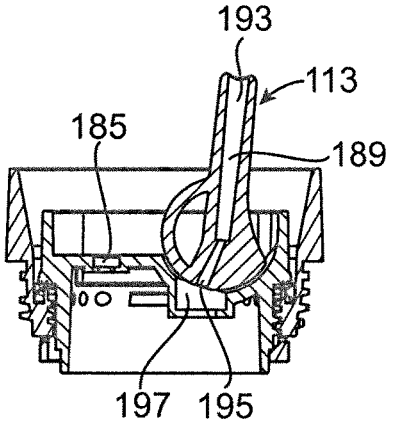

The use of the assembled device is described with respect to the exploded views shown in FIGS. 12A, 12B, and 12C, and in consideration of the "open" and "closed" aspects described with respect to FIGS. 13A and 13B. The twist-top (111) can be seen in the FIGS. to comprise a set of threads (171) disposed radially outward on the middle (173) of the twist-top (111). These threads (171) are configured for rotation and counter rotation with the corresponding inner threads (139) disposed radially inward around the collar middle section (137). These structures facilitate the rotation/counter-rotation of the twist-top (111) with respect to the collar (107).

In the depicted embodiment, the collar inner threads (139) include a thread gap (147), and the twist-top outer threads (171) likewise comprise a corresponding thread gap (175). The width and location of each of these thread gaps (147) and (149) are selected so that when the twist-top (111) is in "open" position, there is at least some overlap between the respective thread gaps (147) and (149) forming a fluid channel between the collar (107) and the twist-top (111). When the twist-top (111) is in "closed" position, however, the gap sections (147) and (149) separate and there is no such overlap, and the fluid channel is eliminated, inhibiting or preventing fluid from flowing. As described elsewhere herein, when in closed position, the twist-top (111) presses down on the gasket (109) to form a seal and further inhibit leakage. These fluid channels may aid in fluid flow when the device is open, but in the depicted embodiment, are not necessary due to the presence of the holes (181) and/or slots (183) described elsewhere. However, it in an alternative embodiment, such holes (181) or slots (183) may be eliminated and the fluid flow through these channels may be the primary, or only, fluid path out of the vessel.

The depicted twist-top (111) further comprises one or more holes (181) and/or slots (183) disposed around the radial periphery. These holes (181) and/or slots (183) provide a fluid path from the interior of the vessel to the sipping rim (141) when the device is open. The size, shape, position, and number of holes (183) and/or slots (185) may be adapted to control or meter the flow rate of liquid. Because these elements (183) and (185) are typically used to consume hot fluid, controlling flow rate reduces the risk of scalding the user. Additionally, when the twist-top (111) is in open position, fluid can flow through the overlapping thread gaps (147) and (149) to the holes (181) and/or slots (183), providing an exit path for fluid to be sipped from the collar rim (143). Again, this may be a supplementary fluid path as described elsewhere herein, or a primary or exclusive fluid path. When used in this manner, the straw (113) is maintained in closed position. In this fashion, the container (101) is suitable for use with hot beverages, which are preferably sipped in small quantities without the use of a straw.

Another aspect of the depicted container (101) is that it may be used with cold beverages, which are preferably consumed by drawing fluid through a straw (113). In the depicted embodiment, the twist-top (111) further comprises a straw element (113) rotatably disposed in a grippable storage recess (191). As shown in the depicted embodiments, the recess (191) is formed from walls extending upward from the top of the twist-top (111), and the walls generally correspond to the exterior shape of the straw (113). This allows the straw to be stowed within the recess (191) when not in use, reducing the risk of damage or inadvertent discharge.

The depicted straw (113) contains a main fluid channel (189) extending from a first end (193) to at least one second end (195) of the straw. The first end (193) is the "sipping" end adapted for a human user to draw fluid through the channel (189). The channels are disposed such that when the straw (113) is in closed position (e.g., stowed in the recess (191)), the second end (195) of the straw does not form a fluid path, but when the straw (113) is in open position (e.g., flipped up), the second end (195) forms a first fluid path (187) from the interior of the vessel (103) through the channel (189) to the atmosphere.

As shown, the first fluid path (187) differs structurally from that of the "sipping" action, and instead proceeds vertically through the twist-top (111) without the need to form an overlapping thread gap. Thus, the straw (113) may be used without rotating the twist-top, and the sipping feature may be used without operating the straw. It should be noted that the depicted straw (113), when fully open, cannot be extended beyond the collar rim. This allows accumulated fluid at the tip of the channel to drip into the "sippable" area of the collar, rather than drip off the edge, where it may soil another surface.

Generally, opening the straw (113) will also open a second fluid communication channel (185) between the interior of the vessel (103) and the atmosphere so that atmospheric pressure can equalize when the straw (113) is in use, and assist with forcing fluid through the straw channel (189). This may be done, for example, by disposing one end of the second fluid communication channel (185) under the straw when stowed, so that this second channel is closed when the straw is not in use, thereby preventing unwanted leakage of fluid when the container is being turned on its side for sipping.

The depicted recess (191) for holding the straw (113) is sized and shaped for ergonomic use as a twisting handle by a human user. That is, the recess (191) has a height sufficient for a typical human user to grip both sides of the recess (191) and apply torque in order to rotate and counter rotate the twist-top (111) within the collar (107) as described herein.

To assemble the container (101), the collar (107) is inserted into the top of the vessel (103) and firmly rotated into place. An adhesive may be disposed between the inner threads of the vessel (103) and the outer threads of the collar (107) to establish a permanent engagement between these two elements, or a removable connection may be established so that the collar (107)/twist-top (111) combination may be separate from the vessel (101) for cleaning and so that unwanted fluid in the vessel (101) can be more easily removed.

Throughout this disclosure, terms such as "generally," "about," and "approximately" may be used, such as, but not necessarily limited to, with respect to geometric terms, including shapes, sizes, dimensions, angles, and distances. One of ordinary skill in the art will understand that, in the context of this disclosure, these terms are used to describe a recognizable attempt to conform a device or component to the qualified term. By way of example and not limitation, components described as being "generally coplanar" will be recognized by one of ordinary skill in the art to not be actually coplanar in a strict geometric sense because a "plane" is a purely geometric construct that does not actually exist and no component is truly "planar," nor are two components ever truly coplanar. Variations from geometric descriptions are unavoidable due to, among other things, manufacturing tolerances resulting in shape variations, defects, imperfections, non-uniform thermal expansion, natural wear, and other deformations. Further, there exists for every object a level of magnification at which geometric descriptors no longer apply due to the nature of matter. One of ordinary skill in the art will understand how to apply relative terms such as "generally," "about," and "approximately" to describe a range of variations from the literal geometric meaning of the qualified term in view of these and other considerations. Additionally, the use of the conjunctive and disjunctive should not necessarily be construed as limiting, and the conjunctive may include the disjunctive, and vice versa.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A liquid dispensing system comprising:

a liquid storage vessel;

a generally annular collar comprising:

a top portion having a contoured inner surface and a rim configured for a human to sip liquid therefrom;

a middle portion adjacent said top portion and comprising:

a first attaching member circumscribing an outer surface of said collar and sealedly attachable to said liquid storage vessel; and a second attaching member circumscribed by an inner surface of said middle portion and having a first gap extending vertically therethrough along said inner surface, said second attaching member comprising at least one stopping element;

a twist-top having a third attaching member circumscribing an outer surface thereof matable with said second attaching member, said third attaching member having a second gap extending vertically therethrough along said outer surface, said third attaching member comprising:

a first detent sized and shaped to allow said stopping element to move over and past said first detent in a first direction to mate said second attaching member to said third attaching member to assemble said liquid dispensing system, and inhibiting said stopping element from moving back over and past said first dent in a second direction opposite said first direction to unmate said second attaching member from said third attaching member to disassemble said liquid dispensing system;

a second detent disposed adjacent said first detent and forming a recess therebetween, said second detent sized and shaped to allow said stopping element to move over and past said second detent stop from either direction with the application of a predetermined amount of torque;

wherein when said second attaching element is mated to said third attaching element to assemble said liquid dispensing system:

said twist-top is rotatable to an open position in which said stopping element is disposed adjacent said first detent;

said twist-stop is rotatable to a closed position in which said stopping element is disposed distal said first detent.

2. The liquid dispensing system of claim 1, wherein said twist-stop further comprises one of more apertures disposed at a radial periphery of said twist-top adjacent a top end of said channel when formed, and disposed on said radial periphery effective to allow liquid flowing through said formed channel to further flow through said one or more apertures and unto said contoured inner surface.

3. The liquid dispensing system of claim 2, wherein said one or apertures disposed at said radial periphery comprises a number of apertures having a size, shape, and disposition on said radial periphery effective to cause liquid to flow through said one or more apertures at a predetermined flow rate.

4. The liquid dispensing system of claim 3, wherein said predetermined flow rate is selected to inhibit hot liquid flowing through said one or more apertures from burning human skin when a human drinks hot liquid through said one or more apertures.

5. The liquid dispensing system of claim 1, wherein said twist-top further comprises a top having a rotatable straw disposed thereon, said rotatable straw having a channel extending therethrough and said rotatable straw adjustable between a closed position in which liquid flow through said channel is inhibited and an open position in which liquid flow said channel is allowed.

6. The liquid dispensing system of claim 5, wherein said straw is disposed in a recess defined by a raised periphery sized and shaped for gripping to rotate said twist-stop with respect to said collar.

7. The liquid dispensing system of claim 6, wherein said twist-top further comprises a secondary vent sized, shaped, and positioned to facilitate liquid flow through said straw when said straw is open via pressure equilibrium.

8. The liquid dispensing system of claim 7, wherein said secondary vent is disposed beneath said straw when said straw is in closed position.

9. The liquid dispensing system of claim 1, further comprising a generally annular gasket having an L-shaped cross-section and sized and shaped to fit between said collar and said twist-top to form a liquid seal therebetween, said fluid channel formed by said first gap and said second gap bypassing said gasket when formed.

10. The liquid dispensing system of claim 1, wherein said first attaching member comprises threads adapted to counter-rotate with corresponding threads on a top interior surface of said liquid storage vessel.

11. The liquid dispensing system of claim 10, wherein said annular collar is permanently affixed to said liquid storage vessel.

12. The liquid dispensing system of claim 11, wherein said liquid storage vessel is an insulated liquid storage vessel.

13. The liquid dispensing system of claim 11, wherein said annular collar is permanently affixed to said liquid storage vessel by an adhesive.

14. The liquid dispensing system of claim 1, wherein said second attaching member comprises threads and said third attaching member comprises corresponding threads.

15. The liquid dispensing system of claim 1, wherein when the second attaching element is mated to the third attaching element to assemble the liquid dispensing system and the twist-top is in said open position, said first gap and said second gap at least partially overlap to form a channel between said collar and said twist top.

16. The liquid dispensing system of claim 15, wherein when the second attaching element is mated to the third attaching element to assemble the liquid dispensing system and the twist-top is in said closed position, said first gap and said second gap do not form a channel between said collar and said twist top.

17. The liquid dispensing system of claim 1, wherein said stopping element is prevented from moving back over and past said first dent in a second direction opposite said first direction unless a second predetermined amount of torque is applied.

18. The liquid dispensing system of claim 17, wherein said second predetermined amount of torque is greater than said predetermined amount of torque.

19. The liquid dispensing system of claim 17, wherein said second predetermined amount of torque is at least ten times greater than said predetermined amount of torque.

* * * * *